US005448138A

United States Patent [19]

Staggs

[11] Patent Number: 5,448,138

[45] Date of Patent: Sep. 5, 1995

[54] AERONAUTICAL OBSTRUCTION LIGHT

[76] Inventor: David Staggs, 11009 Alonda Ct., San Diego, Calif. 92126

[21] Appl. No.: 999,700

[22] Filed: Dec. 22, 1992

[51] Int. Cl.[6] ..... H05B 41/16

[52] U.S. Cl. ..... 315/248; 315/307; 315/308; 315/291; 315/292; 362/391

[58] Field of Search ..... 315/307, 308, 291, 292, 315/248, 200 A; 362/391

[56] References Cited

U.S. PATENT DOCUMENTS 2,095,306 10/1937 Austin ..... 315/76
3,124,712 3/1964 Alexander ..... 315/246
3,427,500 2/1969 Harney et al. ..... 315/200 A
4,277,728 7/1981 Stevens ..... 315/308
4,839,567 6/1989 Milton et al. ..... 315/248
5,001,402 3/1991 Milton et al. ..... 315/248

*Primary Examiner*—Robert J. Pascal
*Assistant Examiner*—Reginald A. Rattiff

[57] ABSTRACT

A light that meets Federal Aviation Administration requirements for marking powerlines or powerline support structures that is powered from the magnetic field created by the conduction of electricity along a powerline. The energy in the naturally occurring magnetic filed induces an electric current in a specialized coil within the device that delivers a constant voltage to a lamp. The lamp is focused through a lens into the beam pattern required for marking powerline support structures.

20 Claims, 1 Drawing Sheet

AERONAUTICAL OBSTRUCTION LIGHT

BACKGROUND OF THE INVENTION

1. Field of the Invention

This invention relates to the marking of powerline support structures with warning lights to prevent aeronautical accidents. Powerline support structure warning lights are commonly referred to as "obstruction lighting equipment." The increase in air traffic, especially by private aeroplanes, has resulted in tragic loss of life due to the inability of pilots to visually detect powerlines and powerline support structures at night. This invention allows obstruction lighting where it is impractical to supply the voltage required for standard incandescent lights. This would be the case in geographically remote areas or on powerlines between powerline support structures.

2. Description of the Prior Art

Powerline support structures require obstruction lighting near airports and along heavily travelled air routes. The standard method practiced is to route a wire from a power source up each powerline support structure to power conventional incandescent lights. The lights must meet the requirements currently stated in the Federal Aviation Administration advisory circular number 150/5345-43D. Powerline support structures less than 150 feet in height typically require one or more L-180 steady burning read obstruction lights. Presently the only standard method to mark the powerlines themselves is with large, brightly painted styrofoam spheres. This technique offers little warning of the location of powerlines at night.

SUMMARY OF THE INVENTION

The invention is composed of a power source, a voltage regulating circuit, a lamp, a lens and hardware necessary to attach the device. The power source is composed of a specialized coil that can provide the required amount of power by transmuting the magnetic field radiated by the powerline into an electric current. The voltage regulating circuit provides a constant voltage regardless of the fluctuations of magnetic field strength. The lamp exploits recent advances in axial mounted halogen filament technology to provide the light intensity, bulb life and operating temperatures required by the Federal Aviation Administration. The lens focuses the required color of light into a 360 degree horizontal beam spread with the required 10 degree minimum vertical beam spread. The hardware allows the entire device to be attached to the powerline, although the lamp may instead be mounted on the transmission line support structure. The novelty of the invention arises from the use of a coil to power an obstruction light from the field generated by powerlines. The design aligns the coil in the optimum physical arrangement to exploit the magnetic field and obviates the need for traditional lighting power sources, thus economizing the marking of aeronautical obstructions.

BRIEF DESCRIPTION OF THE DRAWINGS

The invention is shown in the attached drawing.

FIG. one shows the aeronautical obstruction light (1), where the coil wire (3) is wrapped around the circumference of a toroid (2). The coil is aligned with the powerline (4) by the mating of the coil housing (8) with the upper housing (5). The upper housing (5) supports the lamp base (6), lamp and dome (7). The lamp base (6), encloses the circuitry and optional battery.

Figure 1:
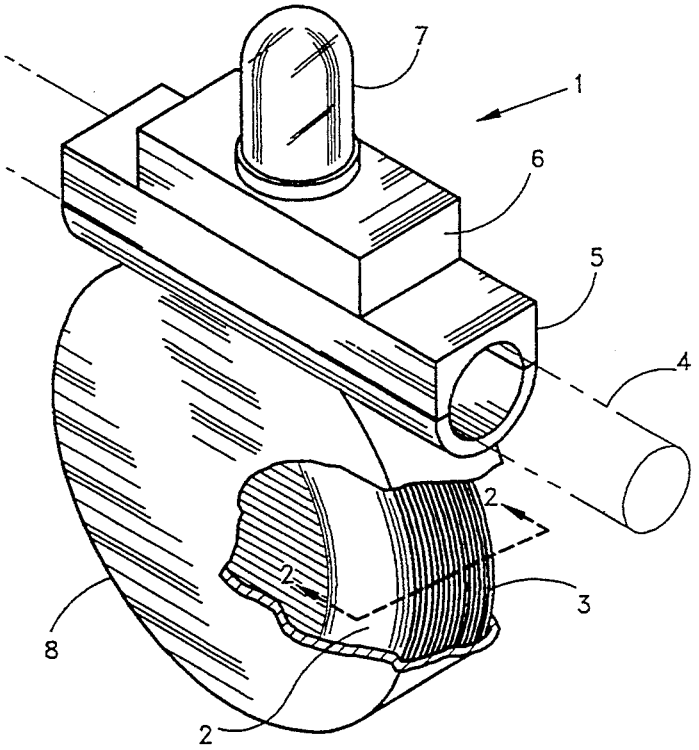
Figure 2:
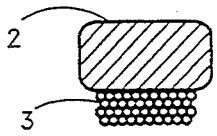
Figure 3:
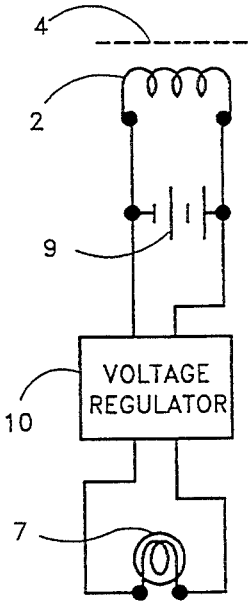
Figure 4:
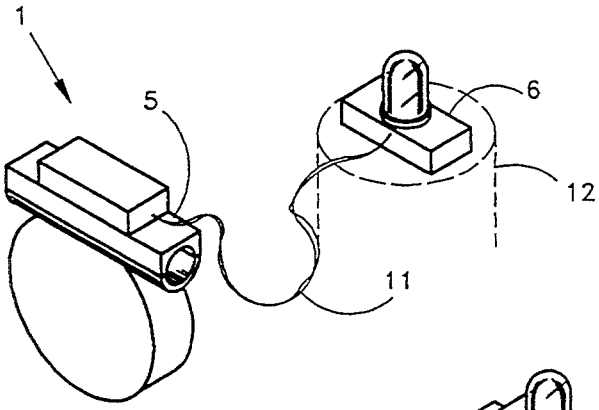
Figure 5:
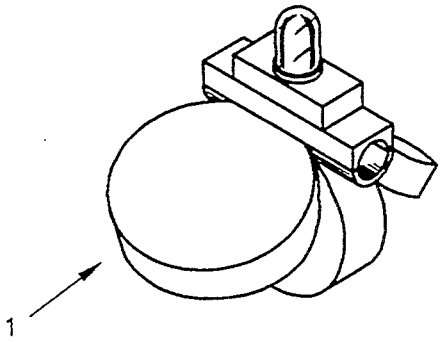
Figure 6:
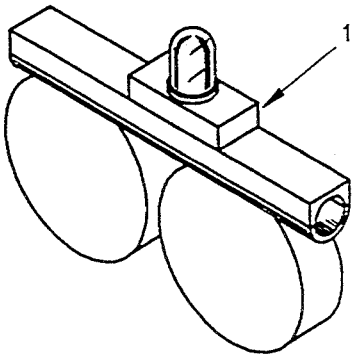

FIG. two shows a cross section of the coil wire (3) wrapped around the circumference of a toroid or elliptical form (2).

FIG. three schematically shows a simple electrical circuit where the current along powerline (4) induces on the coil (2) a voltage that is regulated (10) for use by the lamp (7), on optional battery (9) is also shown.

FIG. four shows the aeronautical obstruction light (1) with the lamp and base (6) mounted remotely, for example, on a powerline support structure (12), with a wire (11) connecting it to the upper housing (5).

FIGS. five and six show embodiments of the aeronautical obstruction light (1) with multiple coils for use in inducing voltage from lower current powerlines that produce weaker magnetic fields.

DESCRIPTION OF THE PREFERRED EMBODIMENT

Providing sufficient current even for high efficiently halogen lamps is a formidable task. The proper coil configuration can be determined by using the formulas presented below. Coil orientation is critical in producing optimum induced voltage and is inherent in the novelty of the invention. The device suspends the coil beneath the powerline insuring that the coil remains parallel at the maximum magnetic field strength density generated by the powerline. The equations below are used, as an example, to determine the coil configuration for a 500 Ampere powerline.

$$V=\omega \cdot S \cdot B \cdot N \qquad \text{EQU. 1}$$

Where $\omega=2\pi f$ $f=60$ Hertz $S=\pi r^2$ Meters $B=$Tesla $N=$number of turns of wire The ability of a coil to generate an electric current in a magnetic field is described in EQU. 1. This equation allows us to determine voltage (V) induced by a magnetic field (B) in relation to the number of turns of wire (N) in the coil of radius (r). It is evident that increasing surface area of the toroidal coil (S) and increasing the number of turns of wire induces more voltage from the coil. An elliptical coil can be used to increase the amount of surface area near the surface of the powerline. In this case (S), above, depends on the semi-major (a) and semi-minor (b) axes:

$$S=\pi \cdot a \cdot b$$

A trade-off exists between coil size and length of wire, since wire length decreases available power as shown in EQU. 3. Calculations were made using the equations to determine the optimized configuration of the coil for the example 500 Ampere circuit. Using the equations resulted in the choice of a coil on a 3 inch diameter toroidal form, composed of about 500 turns of 18 gauge wire. Experiments on a 69 Kilovolt transmission wire confirmed that the example coil will produce about 0.2 volts per Gauss.

The results obtained from measurements from the example coil are shown in Table 1. The first column indicates the distance of the coil from the transmission wire, the second is the recorded magnetic field strength at the coil and the third is the recorded volts induced across the toroidal coil. The induced voltage is about one fourth the theoretical value due to the extreme asymmetry of the field across the diameter of coil.

$$B=\mu_0 \cdot h \cdot 10^4 \qquad \text{EQU 2.}$$

Where:

B=Gauss=Tesla $10^4$ $\mu_0=4\pi 10^{-7}$ Tesla Meter/Amp h=I/(2πD)Amp/Meter

The field strength generated by the conductance of electricity (I) along a wire is described in EQU. 2. The field strength increases as distance (D) to the powerline decreases. Calculations using experimental measurements and computer simulation were made to characterize the expected magnetic field strength for various configurations of powerlines. These results allow us to estimate the power that must be conducted through the powerline to provide the magnetic field strength required to power the device.

The experiments with the example coil that are shown in table 1 demonstrate that a 69 Kilovolt powerline carrying approximately 20 Megawatts will generate around a three Gauss magnetic field at three inches from the powerline and produce around one volt from the coil.

TABLE 1

| RESULTS FROM EXAMPLE COIL | | |
|---|---|---|
| 3 inches | 3.28 gauss | 0.70 volts |
| 4 inches | 2.74 gauss | 0.53 volts |
| 5 inches | 2.24 gauss | 0.42 volts |
| 6 inches | 1.86 gauss | 0.34 volts |
| 7 inches | 1.45 gauss | 0.31 volts |
| 8 inches | 1.15 gauss | 0.23 volts |

Since the device is designed for remote powerline support structures, high tension powerlines were the primary focus. However, using the equations provided, the coil size may also be selected so as to generate the required power from magnetic fields generated by lower voltage powerlines. Additionally, several coil units may be added to lower voltage powerlines and attached in series to reach the power requirements of the light. Available power can also be increased by storing the power from the coil in an attached battery during daylight hours for use at night.

The power provided by the coil can be increased by winding the coil around an iron powder core. An iron powder core of high permeability or a silicon-iron laminate core will increase the voltage across the coil induced by a magnetic field. Wrapping the coil around the circumference of a toroidal core instead of a solid slug will reduce the overall weight of the coil. However, the effect of boosting induced voltage varies in the relation of the height of the core to its diameter. Consequently, the orientation of the coil to the wire limits the height that can be used. Experimental measurements indicate roughly a 20% improvement in voltage output using a high permeability iron powder toroidal core.

The preferred embodiment of the device must meet the requirements currently stated in the Federal Aviation Administration advisory circular number 150/5345-43D to be commercially practicable. Therefore that light output of the device must fall between 30 to 70 Candellas for a steady burning class 1 L-810 obstruction light. The light must function in the temperature range of −55 degrees centigrade to 55 degrees centigrade. Although many light sources provide higher light efficiency, halogen bulbs are the most efficient lamp that can operate throughout this temperature range. The recently introduced axial filament orientation is the preferred lamp type because it provides evenly distributed light output throughout the required 360 degree horizontal beam spread.

The Federal Aviation Administration requires obstruction lights to have a lamp life of a least 2,000 hours before failure. The lamp operating life in the preferred embodiment may be extended beyond the minimum requirements by derating filament voltage and still providing the required light output at voltages that would typically be generated from the coil.

The light output of the bulbs may be increased by up to a factor of five with a suitable commercially available lens. The required vertical beam spread of at least 10 degrees and the required International Commission on Illumination Chromaticity y co-ordinate of less than 0.335 is achieved using a commercially available dome-shaped lens. The required light intensity is achieved using a halogen lamp with an axial filament that requires about 12 Watts of power (e.g. Osram 64410 or 64425AX).

$$W=\frac{\left(\frac{V}{2}\right)^2}{R} \qquad \text{EQU. 3}$$

The available power delivered by the coil is described in EQU. 3. Where the resistance (R) from 18 gage wire is 6.3 Ohms per 1000 feet and V is the induced voltage across the coil. The optimal power from the coil is achieved by making the load resistance about equal to the coil resistance. The required resistance and voltage will determine the choice of wire thickness and the surface area of the coil.

Using EQU. 2 and assuming a 500 Ampere current, we expect a field strength of about 40 Gauss at one inch from the wire. Using EQU. 1, we expect a voltage of about 50 volts. Based on empirical data from our example coil, we would expect the coil to generate at least 12 volts. Since the resistance of the example coil was 2.7 Ohms, the power from the coil, using EQU. 3, would be about 12 watts. Commercially available axial mounted halogen bulbs will produce about 11 Candellas of light at 12 watts. This configuration would supply around 50 Candella through the focusing lens. These calculation show that the example coil would be appropriate to power an obstruction light on a powerline carrying a current of 500 Amperes.

While I have described and shown the particular embodiments of my invention, it should be understood that many modifications may be made without departing from the spirit thereof, and I contemplate by the appended claims to cover any such modifications as fall within the true spirit and scope of my invention.

What I claim is:

1. A lighting device for use in marking aeronautical obstructions comprising:

(a) voltage source means for producing an electrical voltage from an interacting magnetic field, whereby said lighting device does not require a direct electrical connection to an external power source, (b) regulating circuit means electrically connected to said voltage source means that provides a steady voltage from said voltage source means, and, (c) illumination means electrically connected to said regulating circuit means that provides illumination adequate to mark an aeronautical obstruction.

2. The lighting device of claim 1 wherein said voltage source means comprises a plurality of electrically connected voltage source means, whereby sufficient voltage can be acquired from interaction with weaker magnetic fields.

3. The lighting device of claim 1 wherein said voltage source means comprises electrically conductive wire coiled into a toroidial shape.

4. The lighting device of claim 1 wherein said voltage source means comprises electrically conductive wire coiled into an elliptical shape.

5. The lighting device of claim 1 further comprising a battery electrically connected to said voltage source means for storing power from said voltage source means for use by electrically connected said voltage regulating means when required.

6. A lighting device for use in marking electric powerlines as aeronautical obstructions comprising:

(a) voltage source means mounted near the electric powerline for producing an electrical voltage from the interacting magnetic field generated during the transmission of electricity along said electric powerline, whereby said lighting device does not require a direct electrical connection to an external power source, (b) regulating circuit means electrically connected to said voltage source means that provides a steady voltage from said voltage source means, (c) illumination means electrically connected to said regulating circuit means, and, (d) focusing means encasing said illumination means so that said illumination means is adequate to mark an aeronautical obstruction.

7. The lighting device of claim 6 wherein said voltage source means comprises a plurality of electrically connected voltage source means.

8. The lighting device of claim 6 wherein said voltage source means comprises electrically conductive wire coiled into a toroidial shape.

9. The lighting device of claim 6 wherein said voltage source means comprises electrically conductive wire coiled into an elliptical shape.

10. The lighting device of claim 6 wherein said illumination means is mounted remotely from the powerline, whereby electric powerline support structures can also be marked.

11. The lighting device of claim 6 further comprising a battery electrically connected to said voltage source means for storing power from said voltage source means for use by electrically connected said voltage regulating means when required.

12. A lighting device for use in marking electric powerlines as aeronautical obstructions comprising:

(a) voltage source means mounted on the electric powerline for producing an electrical voltage from the interacting magnetic field generated during the transmission of electricity along said electric powerline, whereby said lighting device does not require a direct electrical connection to an external power source, (b) regulating circuit means electrically connected to said voltage source means that provides a steady voltage from said voltage source means, (c) illumination means electrically connected to said regulating circuit means, and, (d) focusing means encasing said illumination means that focuses said illumination means into a 360 degree beam adequate to mark an aeronautical obstruction.

13. The lighting device of claim 12 wherein said voltage source means are spatially oriented parallel to said electric powerline and perpendicular to said interacting magnetic field generated by transmission of electricity along said electric powerline.

14. The lighting device of claim 12 wherein said voltage source means comprises a plurality of electrically connected voltage source means, whereby sufficient voltage can be acquired from interaction with weaker magnetic fields from said electric powerline.

15. The lighting device of claim 12 wherein said voltage source means comprises electrically conductive wire coiled into a toroidial shape.

16. The lighting device of claim 12 wherein said voltage source means comprises electrically conductive wire coiled into an elliptical shape.

17. The lighting device of claim 12 wherein said illumination means is a non-flashing lamp.

18. The lighting device of claim 12 wherein said illumination means is a halogen lamp.

19. The lighting device of claim 12 wherein said illumination means is mounted remotely from the electric powerline, whereby electric powerline support structures can also be marked as aeronautical obstructions.

20. The lighting device of claim 12 further comprising a battery electrically connected to said voltage source means for storing power from said voltage source means for use by said electrically connected voltage regulating means when required.

* * * * *